United States Patent [19]

Moudgil et al.

[11] 4,284,499

[45] Aug. 18, 1981

[54] APPARATUS FOR THE FLOAT CONCENTRATION OF ORE

[75] Inventors: Brij M. Moudgil, New York, N.Y.; Booker W. Morey, Portola Valley, Calif.

[73] Assignee: Occidental Research Corporation, Irvine, Calif.

[21] Appl. No.: 98,363

[22] Filed: Nov. 28, 1979

Related U.S. Application Data

[63] Continuation-in-part of Ser. No. 897,778, Apr. 19, 1978, abandoned.

[51] Int. Cl.[3] ..... B03D 1/02; B03D 1/14

[52] U.S. Cl. ..... 209/166; 209/168

[58] Field of Search ..... 209/4, 5, 9, 13, 18, 209/166–168, 170, 207, 458, 459, 443, 438, 493

[56] References Cited

U.S. PATENT DOCUMENTS

| | | | |
|---|---|---|---|
| 1,263,503 | 4/1918 | Wood | 209/207 |
| 1,328,456 | 1/1920 | Ross | 209/170 X |
| 1,409,385 | 3/1922 | McDougall | 209/458 |
| 1,491,110 | 4/1924 | Spearman | 209/170 X |
| 1,497,804 | 6/1924 | Spearman | 209/170 X |
| 2,120,535 | 6/1938 | Wilkinson | 209/49 |
| 2,267,496 | 12/1941 | Ellis et al. | 209/166 |
| 2,330,875 | 10/1943 | Ellis et al. | 209/166 X |
| 2,536,286 | 1/1951 | Hewett et al. | 209/18 X |
| 2,646,882 | 7/1953 | Frost | 209/170 |
| 2,905,322 | 9/1959 | Cannon | 209/459 X |
| 2,966,262 | 12/1960 | Hobart | 209/13 |
| 3,326,373 | 6/1967 | Lang | 209/18 |
| 3,472,379 | 10/1969 | Lainas et al. | 209/493 X |

FOREIGN PATENT DOCUMENTS

| | | | |
|---|---|---|---|
| 11139 | 1/1928 | Australia | 209/458 |
| 631451 | 6/1936 | Fed. Rep. of Germany | 209/458 |
| 486854 | 5/1918 | France | 209/207 |

*Primary Examiner*—Ralph J. Hill

*Attorney, Agent, or Firm*—Christie, Parker & Hale

[57] ABSTRACT

An apparatus and a method for concentrating an ore to recover valuable minerals from the ore is disclosed. The apparatus is based upon flotation separation techniques and comprises a trough into which is fed a slurry of ore particles which have been conditioned with a flotation reagent. The trough has a side extending outwardly forming a downwardly sloping flat table. The slurry of conditioned ore particles flows out of the trough and downwardly along the sloping table. Positioned along the sloping table is a disperser for dispersing larger particles up and into the slurry, which larger particles are generally along the surface of the sloping table. The sloping table is equipped with at least one aerator positioned along the flow path of the slurry, downstream of the disperser which aerates the conditioned ore slurry. The particles coated with the flotation reagent form agglomerates with gas bubbles produced by the aerator. These agglomerates float at a higher level within the slurry than the non-coated, non-agglomerating ore particles. A splitter is positioned near an open end of the sloping table. The splitter height above the surface of the sloping table is adjustable for intersecting the conditioned ore slurry at differing levels. The splitter separates the agglomerative, coated particles floating at a higher level from the non-agglomerative, non-coated particles floating at a lower level in the slurry.

11 Claims, 3 Drawing Figures

APPARATUS FOR THE FLOAT CONCENTRATION OF ORE

CROSS-REFERENCE TO RELATED CASE

This application is a continuation-in-part of U.S. Ser. No. 897,778, of Brij M. Moudgil and Booker W. Morey, titled APPARATUS AND METHOD FOR THE CONCENTRATION OF ORE, filed on Apr. 19, 1978, which is hereby incorporated herein.

BACKGROUND OF THE INVENTION

The present invention relates to an apparatus and method for the concentration of ore by flotation. In particular, it relates to the concentration of an ore by flotation wherein a portion of the ore is coated with a beneficiating amount of a flotation reagent and the reagent-coated particles form a concentrate floating at a higher level in the float medium than the non-coated particles due to aeration of the conditioned ore slurry. More particularly, it relates to an apparatus and method for the concentration of coarse phosphate rock by agglomerative flotation.

Flotation has been used since the early 1900's as an important part of the ore concentration process. For example, more than two-thirds of the phosphate rock produced in Florida is upgraded by the flotation process. Since no crushing or milling steps are involved in the material preparation, the flotation plant feed is coarser than in most other mineral flotation systems. During hydraulic processing of the rock, particles in the size range of −14 to +150 mesh constitute the flotation feed. This size fraction is further classified by hydraulic sizers, stationary screens and vibrating screens into a coarse −14 to +35 mesh and a fine −35 to +150 mesh flotation feed. The flotation techniques for concentrating the fine feed as practiced by the Florida phosphate producers have generally been standardized over the years, however, methods for upgrading the coarse feed differ within the industry.

In the past, treatment of the coarse feed fraction by conventional flotation machines has been found to be inefficient and uneconomical because of low recoveries. Efforts were made to reduce the coarse size fraction by hammer mills, but this was found to be uneconomical and was discontinued.

The lower recoveries in conventional flotation cells have been attributed to the inability of air bubbles to carry the relatively larger particles up to the froth column. Generally, recovery of particles coarser than 28 mesh is poor when employing conventional flotation techniques for upgrading the coarse feed.

The three flotation separation processes, froth flotation, agglomeration flotation and skin flotation are based upon the same fundamental principle of selective adhesion. They differ from each other in the physical means that are employed to achieve the desired separation. In froth flotation, or conventional flotation, small mineral particles attach to gas bubbles in such a way that the specific gravity of the "loaded" gas bubble is less than that of the pulp. This results in loaded bubbles rising through the pulp and forming a mineralized froth. The mineralized froth is then mechanically separated from the pulp.

In agglomeration flotation, mineral particles are loosely bonded with relatively smaller gas bubbles to form agglomerates. These agglomerates are denser than water but less dense and larger than particles wetted with water. Separation of the agglomerated and non-agglomerated particles is achieved by flowing film, gravity concentration. The particles which can be separated by agglomeration are substantially coarser than those separated by froth flotation. When brought into contact with a free water surface, agglomerates are replaced by skin floating individual particles.

In skin flotation, surface tension forces result in flotation of the non-wetted particles. The particles which are wetted with water sink and therefore can be separated from the particles floating at the gas-liquid interface. Coarser particles can be concentrated using skin flotation than can be efficiently handled by froth flotation.

The basic property of selective adhesion, in all three separation processes, is based on the natural or induced flotability of the mineral particles. The degree of flotability of the mineral particles can be modified by selective absorption of surface active agents. Surface tension forces are also important in all three separation processes.

For concentration of coarse phosphate, most techniques other than froth flotation employ a combination of agglomeration and skin flotation processes. Even though the agglomerates formed in the pulp are denser than water, they rise to the gas-liquid interface because of the hydrodynamic forces generated in the pulp. Once the agglomerates reach the gas-liquid interface, they skin float and become separated from the non-agglomerating particles which remain suspended in the pulp.

Lang launders, belt flotation and spiral flotation are currently employed for concentrating coarse phosphate feed. The Lang launder method is disclosed in U.S. Pat. No. 3,326,373. The belt flotation method was developed in the late 1930's. A belt flotation method and apparatus is disclosed in U.S. Pat. No. 2,047,773 to Green and Wilbur. Spiral flotation was developed and has been in use since the late 1940's. Table flotation has been utilized in the separation of coarse phosphate rock since about 1934 but its use has diminished. A process for table flotation is described in U.S. Pat. No. 1,968,008 to Chapman and Littleford. In all these methods, separation is achieved by skin flotation of the phosphate agglomerates. Separation of phosphate agglomerates from gangue minerals is achieved by sizing in underwater agglomerate screening, which was one of the earliest methods devised for recovery of phosphate from −20 mesh material. Underwater agglomerate screening utilizes oil agglomeration of coarse phosphate particles in the absence of aeration. Such processes are taught in U.S. Pat. No. 2,017,468 to McCoy, Wright and Hall and U.S. Pat. No. 2,113,727 to Hall and Hodges.

Froth flotation is also practiced on coarse phosphate feed and is similar to rougher flotation of fine phosphate feed. Low recoveries of coarse phosphate rock in froth flotation has led to the use of larger flotation cells to increase efficiency. Such larger flotation cells include 50 cubic feet cells made by Denver Equipment Co., 100 cubic feet cells made by Galigher Co. and 300 cubic feet cells made by Wemco division of Envirotech Corp.

The methods currently in use for separation of coarse phosphate rock have their disadvantages and advantages. For example, during froth flotation in the large flotation cells, of the +35 mesh fraction feed to the cells, less of the total coarse feed is recovered. Major limitations of table flotation are excessive maintenance of the equipment and the need for precise control of the feed size. In underwater agglomerate screening, large amounts of reagents are required to achieve satisfactory separation and strict control of feed size is required. Of the three techniques presently being employed for coarse feed concentration, belt flotation has a relatively lower throughput capacity for the floor space required. In spiral flotation feed size control is essential to achieve desired separation. Rougher concentrate from Lang launders, belt flotation and froth flotation circuits has to go through a cleaner circuit to produce a final concentrate. The concentrate produced from spiral flotation and table flotation generally does not require any further cleaning. These techniques are further described in the paper entitled "Agglomeration-Skin Flotation of Coarse Phosphate Rock," by Brij M. Moudgil and Dave H. Barnett, presented at the annual meeting of AIME in Atlanta, Georgia, Mar. 6–10, 1977.

SUMMARY OF THE INVENTION

In accordance with this invention, there is disclosed an apparatus and method for the concentration of an ore. The apparatus for the concentration of ore comprises a trough having an outwardly extending side forming a downwardly sloping flat table enclosed on two parallel sides and open on the end opposite the trough. Means are provided for feeding a slurry of conditioned ore to the trough. At least one aerator is positioned along the surface of the sloping flat table. Positioned along the table between the trough and aerator is at least one disperser for dispersing particles tending to flow along the surface of the table up into the slurry. A splitter is positioned near the open end, adjustably above the surface of the table. The splitter extends outwardly forming a sloping splitter table enclosed on two parallel sides and forming a splitter collecting trough on the end opposite the splitter. A collecting trough is positioned below the open end of the sloping flat table.

The apparatus can also comprise a second sloping flat table for recovering additional ore values from the first non-float portion of the slurry treated and recovered from the first sloping flat table. When such a second flotation is to be conducted, the collecting trough below the open end of the first sloping flat table, comprises a trough having a side which extends outwardly forming a second downwardly sloping flat table, enclosed on two parallel sides and open on the end opposite the collecting trough. Means are provided for adding a beneficiating amount of flotation reagent to the slurry in the collecting trough. At least one second aerator is positioned along the surface of the second sloping flat table. Positioned along the second table between the collecting trough and second aerator is at least one second disperser for dispersing particles tending to flow along the surface of the second table up into the slurry. A second splitter is positioned near the open end, adjustably above the surface of the second table. The second splitter extends outwardly forming a second sloping splitter table enclosed on two parallel sides and forming a second splitter collecting trough on the end opposite said second splitter. A second collecting trough is positioned below the open end of the second table.

In accordance with the method of this invention, a float fraction and a non-float fraction contained in a slurry of ore particles conditioned with a flotation reagent are separated by the steps of feeding the conditioned slurry into a trough wherein the conditioned slurry flows onto a downwardly sloping flat table; dispersing the particles randomly through the slurry aerating the conditioned slurry as it flows down the table, creating a float concentrate and a non-float fraction within the slurry; positioning an adjustable splitter within the slurry along the flow path of the slurry for separating the float concentrate fraction from the non-float fraction; separating the float concentrate from the non-float fraction by positioning the splitter for passing the float concentrate over the splitter and passing the non-float fraction below the splitter; and separately collecting the float concentrate and non-float fraction.

Further, in accordance with the method of this invention, additional ore values can be obtained from the separated, non-float fraction of the slurry by the additional steps of conditioning the non-float fraction with a beneficiating amount of a flotation reagent; flowing the resultant beneficiated slurry over a downwardly sloping flat table; dispersing the ore particles randomly throughout the slurry; aerating the beneficiated slurry as it flows over the table, creating a float middling fraction and a non-float tailing fraction in the beneficiated slurry; positioning an adjustable splitter along the path of flow of the beneficiated slurry and separating the middling from the tailing by passing the middling over the splitter and passing the tailings below the splitter; and separately collecting the middling and the tailing.

BRIEF DESCRIPTION OF THE DRAWINGS

These and other features, aspects and advantages of the present invention will become more apparent when considered with respect to the following description, appended claims and accompanying drawings in which:

DETAILED DESCRIPTION OF THE INVENTION

Figure 1:
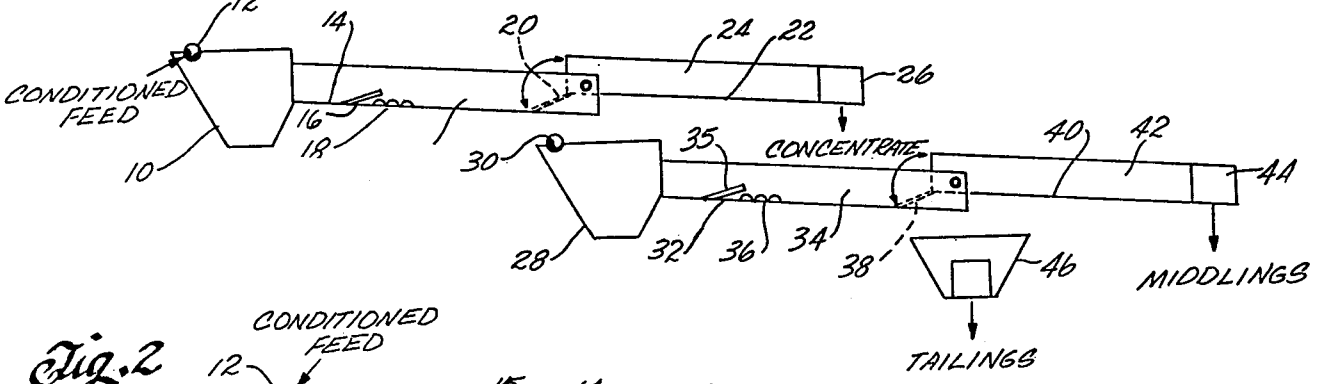
FIG. 1 is a prospective schematic view of an embodiment of the invention.

With reference to FIG. 1, an elongated trough 10 receives conditioned ore in the form of a slurry through feed means 12. Such a slurry can be an aqueous slurry containing the conditioned ore. The ore in the slurry fed to the trough 10 has been conditioned in a conditioning zone (not shown) with a beneficiating amount of at least one flotation reagent which selectively coats one component of the ore to the substantial exclusion of coating the other components. The trough 10 is adapted with an outwardly extending side which forms a downwardly sloping flat table 14. The slope of the table 14 can be adjusted to increase or decrease the rate of flow of the slurry down the table 14. The conditioned slurry in trough 10 floats over the extended side of the trough, onto and down the sloping table 14. The sloping table 14 has sides 15 which contain the slurry on the sloping table 14 and prevent the slurry from running off the edges of the table. The sloping table 14 has an open end opposite the trough. Sloping table 14 has a downward slope toward the open end for allowing flow of the slurry toward such open end.

Conditioned slurry fed to the trough 10 causes the slurry within the trough 10 to overflow onto and down the sloping table 14. As the slurry of conditioned ore flows over table 14, it encounters at least one disperser 16. The disperser 16 can be a static or vibrating, flat or curved surface. In addition to being a surface, the disperser can be a plurality of fluid jets, such as water jets. The disperser 16 disperses ore particles in the slurry randomly throughout the slurry. In particular, it disperses ore particles in the slurry, such as larger and denser particles, that tend to flow along near the surface of the sloping flat table 14. The disperser 16 directs the particles near the surface of the sloping flat table 14 up and into the slurry. By dispersing such particles away from the surface, such particles do not block or otherwise interfere with the beneficiating action of the aerators 18. For example, coarser and heavier particles in a flowing slurry stream tend to settle down and move along the bottom of the container. In a system where aeration is provided through some arrangement along the sloping surface, the moving bed of coarser and heavier particles can interfere with the bubbles being released by the aeration device which bubbles are for collecting and carrying the reagentized particles toward the liquid-gas interface. The particle bed moving over the aeration device can result in reduced bubble size and can otherwise interfere with the bubbles such that they are unable to lift the reagentized particles, especially the coarser and heavier particles. The terms "coarser" and "heavier" are relative terms and as the beneficiating action of the aerators decreases, the size of the ore particles that are effectively floated by such aeration decreases. In addition, the turbulent conditions that can arise in the slurry stream as a result of the heavier and coarser particles interfering with the aerators can also result in separation of other particles from the bubbles carrying such other particles toward the liquid-gas interface. Separation efficiency can be decreased also by aggregation of such particles flowing along near the surface due to interaction between surface coatings in the reagentized particles, which occurs especially when oily reagents are used.

The disperser 16 can be a plate or surface as shown in FIG. 1. The disperser 16 is positioned ahead (upstream) of the aerator 18. Such a plate disperser 16 can be of a curved or flat shape and is positioned for providing maximum dispersion of particles within the slurry. It is preferred that the disperser 16 can be adjusted to the desired angle to disperse particles within the slurry, the angle dependent upon the size of the particles and the flow rate of the slurry. The disperser 16 is preferably positioned such that the particle trajectory, after leaving the disperser, is at a maximum distance, or approaching it, from the sloping table 14 when such particle comes into contact with the gas bubbles released by the aerators 18. In addition to the angle of the disperser 16 being attenuable, the position of the disperser 16 along the sloping table 14 can also be adjusted at least within the distance between the trough 10 and the aerator 18.

Figure 3:
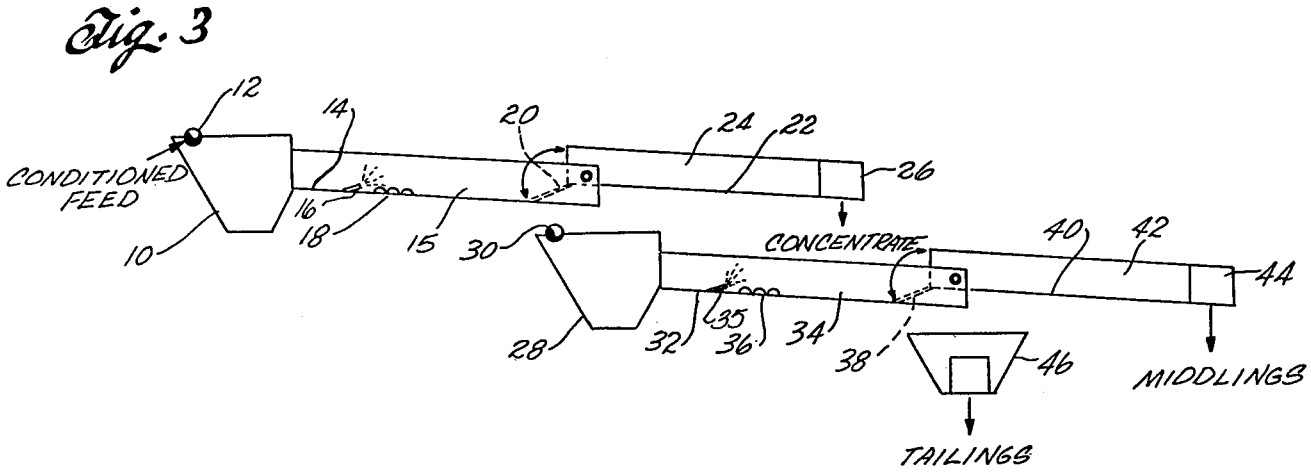
FIG. 3 is a prospective schematic view of another embodiment of the apparatus herein.

The disperser 16 can also be a fluid jet or plurality of fluid jets (as shown in FIG. 3) which emit a fluid, such as water or air, with sufficient force to propel the ore particles near the surface upwardly into the slurry. The disperser 16, for example, can be a series of water jets positioned across the flow path of the slurry which are angled to propel ore particles in a path such that the particles are at or are approaching the maximum distance from the surface of the sloping table 14 when the particles encounter the bubbles emitted by the aerator 18. When fluid jets are utilized as the disperser, the pressure of the fluid can be attenuated to provide the desired force to propel the particles higher in the slurry. Such fluid jets are also adjustably positionable with regard to the angle and direction of fluid spray.

The disperser 16 modifies the flow of the slurry and the suspension behavior of the ore particles within the slurry in such a manner that the gas bubbles generated by the aerator 18 are not significantly affected by the coarser and heavier particles. The coarser and heavier particles do not significantly affect the gas bubbles as the pathway of such particles is such that the particles are at their maximum height within the slurry when they encounter the gas bubbles.

The disperser 16 can be static or vibrating when dispersing the ore particles through the slurry. When the disperser 16 is vibrating, the vibrations can aid in the breaking up of aggregates (formed by the interaction between surface coatings on particles) of particles, thus making the particles within the aggregate amenable to the beneficiating action of the gas bubbles. For example, flotation reagent-coated particles within an aggregate can be made to float at a higher level in the slurry by the action of the gas bubbles after the aggregate is broken up. Fluid jets, when used as a disperser can also provide the same action as a vibrating disperser in breaking up formed aggregates.

Aerators 18 are positioned on the surface of table 14 and provide a gas, such as air, which is bubbled through the slurry. The position of such aerators along the surface of the table 14 can be varied to optimize the efficiency of aeration. The gas bubbled through the slurry attaches to and forms agglomerates with the particles in the slurry that have been coated with the flotation reagent. The agglomerates formed can be denser than water but less dense and larger than the non-agglomerating particles. Even though the agglomerates are denser than water, they tend to float within the slurry of conditioned ore at a higher level than the non-coated particles of ore. Generally, due to the hydrodynamic forces generated in the slurry, the agglomerates float to a gas-liquid interface of the slurry. With aeration there is formed a float concentrate fraction of particles and a non-float, tailing fraction of particles within the slurry.

A splitter 20 is positioned at the open end of sloping table 14 in the flow path of the ore slurry. Splitter 20 is adjustable for varying the height of the splitter above the surface of the table 14. The splitter 20 can be adjusted to intersect the conditioned ore slurry at various levels for separating the slurry thereby providing different fractions passing above and below the splitter. Preferably, the splitter 20 is adjusted to intersect the slurry at the interface between the concentrate and tailing for providing separation of the concentrate from the tailing. The splitter 20 is adjusted to allow flow of the concentrate substantially containing the coated ore particles above the splitter and allows flow of the tailing, containing substantially the non-coated particles, below the splitter.

The splitter 20 extends outwardly forming a downwardly sloping flat splitter table 22. The splitter table 22 has sides 24 and a collecting trough 26 at the end opposite the splitter. The slope of splitter table 22 can be varied for increasing or decreasing the rate of flow of the float or concentrate fraction of the slurry. The concentrate fraction passing above the splitter flows down the splitter table 22 and is collected in the collecting trough 26. The sides 24 contain the concentrate fraction on the splitter table 22. The tailing fraction of the ore slurry flowing below splitter 20 falls out of the open end of the sloping table 14 into a collecting trough 28.

For many applications, the above-described apparatus is sufficient for concentrating an ore. However, in other applications, it is desirable to obtain additional mineral values which can be contained within a previous tailing. The following continuing description of the embodiment shown in FIGS. 1 and 2 relates to such an application for recovering such additional mineral values from such a previous non-float fraction or tailing.

The collecting trough 28 is adapted with a flotation reagent feed means 30 whereby a beneficiating amount of a flotation reagent is added to the slurry in the trough 28 for beneficiating the previous non-float fraction or tailing. The reconditioned slurry in the collecting trough 28 overflows a side of the trough 28 onto a second sloping table 32. The second sloping table 32 is formed by an extending side of the trough 28 which slopes downwardly to an open end opposite the trough 28. The slope of the second table 32 can be varied for increasing or decreasing the rate of flow of the reconditioned slurry. The second sloping table 32 has sides 34 for containing the flow of the reconditioned slurry. As the reconditioned slurry flows down the second sloping table 32 toward the open end, it flows across at least one second disperser 35. Such a second disperser 35 can be a disperser such as defined with regard to disperser 16. The disperser 35 disperses those particles in the slurry near the surface of the second sloping table 32 upwardly in the slurry for preventing and inhibiting such particles from otherwise interfering with the beneficiating action of aerators along the second sloping table 32. As described above with regard to disperser 16, the disperser 35 can be plate-like (flat surface), curved, static or vibrating, angularly adjustable, positionably adjustable, or a fluid jet. The disperser 35 is preferably adjusted and positioned for dispersing particles such that the particles attain a maximum height or are approaching such maximum height within the slurry when such particles encounter the gas bubbles emitted by the aerators.

The slurry flowing down the second sloping table 32 also encounters, after having encountered the disperser 35, at least one second aerator 36. The position of such at least one second aerator 36 can be varied along the surface of the second table 32 for optimizing the aeration of the slurry. As the slurry flows across the second aerator 36, a gas, such as air, is emitted from the second aerator and bubbled through the slurry. The flotation reagent-coated particles within the slurry form agglomerates with the gas from the second aerator 36. The agglomerates tend to form a middling fraction which floats at a higher level than the non-coated particles forming a tailing fraction in the slurry.

A second splitter 38 is positioned at the open end of the second sloping table 32 within the flow path of the slurry, opposite the collecting trough 28. The height of the second splitter 38 above the surface of the second sloping table 32 can be adjusted to intersect the flowing slurry at various levels. Preferably, the second splitter 38 is adjusted to intersect the slurry at the interface between the middling and tailing fraction.

The second splitter 38 separates the middling and tailing by allowing the middling to flow over and the tailing to flow under the second splitter. The second splitter 38 extends outwardly forming a downwardly sloping second splitter table 40. The middling fraction of the slurry passing above the second splitter 38 flows down the second splitter table 40, having sides 42 for confining the flow of the middling and is collected in a second splitter collecting trough 44 at the end of the second splitter table 40. The tailing fraction of the slurry flowing under second splitter 38 flows out of the open end of the second sloping table 32 and into second collecting trough 46.

FIG. 3 illustrates another embodiment of the apparatus herein. The apparatus of FIG. 3 has disperser 16 and second disperser 35 as a fluid jet. Such fluid jets can be fluid jets which emit a liquid, e.g., water, or a gas, e.g., air. Such fluid jets function in a manner as described hereinbefore and as described in general terms with regard to the disperser 16 and second disperser 35. In FIG. 3, the elements of the apparatus have the same numbering as the like elements in the apparatus of FIGS. 1 and 2.

Figure 2:
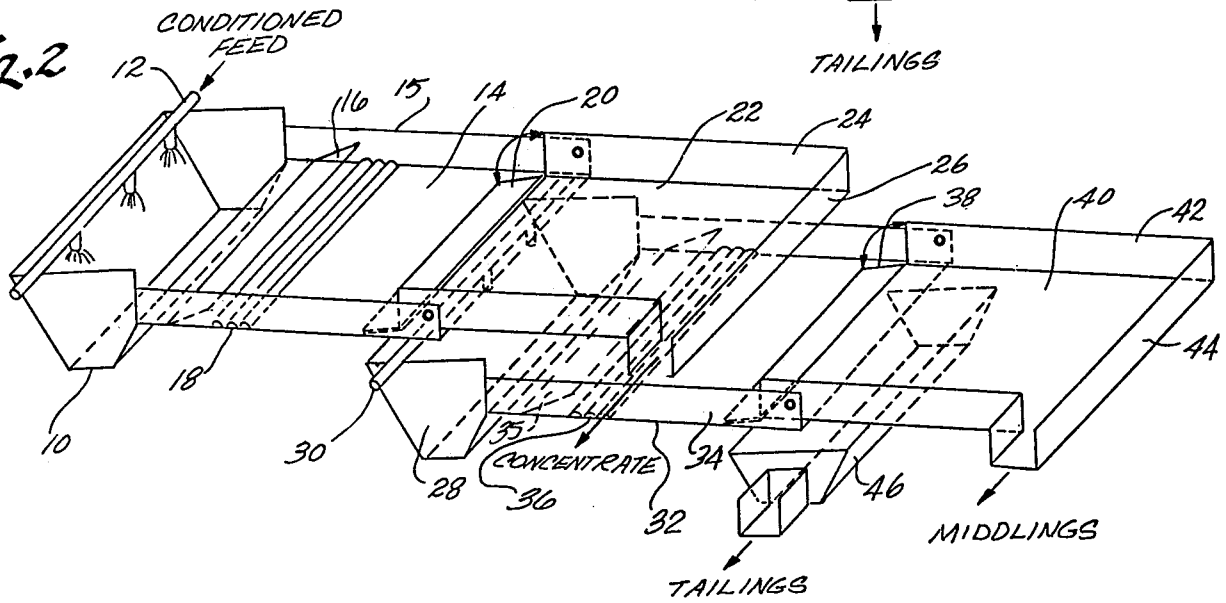
FIG. 2 is a lateral schematic view of the embodiment shown in FIG. 1.

Using the apparatus as shown in FIGS. 1, 2 and 3, a conditioned ore can be separated into three fractions. The first fraction is the float concentrate separated from the ore slurry by the first splitter. The second and third fractions are formed from the tailing or non-float fraction passing below the first splitter and collected in trough 28. This tailing or non-float fraction of the ore slurry can be reconditioned, however, in some instances such reconditioning need not be necessary with the flotation reagent forming two fractions, a float middling fraction and another tailing fraction, which fractions are separated by the second splitter 38. The concentrate substantially contains a concentrate of the material separated. The middling obtained substantially contains a lower grade of the material separated. The remaining tailing fraction contains substantially none of the material separated and any such material it does contain is lower in grade than that in the float fractions (concentrate and middling).

The invention is further illustrated by the following example which is not intended to be limiting.

EXAMPLE 1

An aqueous slurry of phosphate rock ore with an average particle size of −14 to +35 mesh and water is prepared, i.e., about 10 to 40 percent by weight ore. The ore slurry is conditioned with a flotation reagent, such as NeoFat 94-04, that selectively coats the phosphate particles to the substantial exclusion of coating gangue present in the ore. (NeoFat 94-04 is a trademark of Armour Industrial Chemicals Company for a technical grade mixture of unsaturated fatty acid, primarily oleic acid).

The aqueous slurry is fed into a trough wherein the aqueous phosphate-rock slurry flows over the side of the trough onto a downwardly sloping flat table. The downwardly sloping flat table is equipped with a disperser for dispersing the coarser and heavier particles upward in the slurry and a plurality of aerators along its surface. The disperser is a vibrating flat surface that directs such particles in a flow path such that the particles attain their maximum height within the slurry when the particles encounter air bubbles from the aerators. Air is bubbled through the slurry as it flows down the sloping flat table. Two fractions develop within the aqueous slurry. The float fraction substantially comprises the flotation reagent-coated phosphate particles. The tailing fraction substantially comprises the non-coated particles present in the phosphate ore.

An adjustable splitter is positioned along the flow path of the aqueous slurry. The height of the splitter above the surface of the downwardly sloping flat table is adjusted to intersect the aqueous slurry at about the interface between the float concentrate fraction and essentially non-float tailing fraction. The concentrate containing the flotation reagent-coated phosphate particles passes over the splitter onto a downwardly sloping flat splitter table and is collected as a concentrate having a relatively high phosphate content. The tailing fraction passes below the splitter and flows off the end of the downwardly sloping flat table and is collected in a collecting trough positioned therebelow.

A beneficiating amount of Armac T flotation reagent is added to the collected aqueous slurry containing the tailing forming a reconditioned aqueous slurry. This reconditioned aqueous slurry contains flotation reagent-coated phosphate particles of a lesser grade than the phosphate-containing particles in the initial concentrate.

The reconditioned aqueous slurry flows out of the trough and down a second downwardly sloping flat table. The reconditioned slurry flows down the second table encountering a second disperser. The second disperser disperses those ore particles near the surface of the table upwardly in the slurry in a path such that the particles attain their maximum height when they encounter air bubbles produced from the aerator. A plurality of aerators is positioned along the surface of the second downwardly sloping flat table for providing aeration to the reconditioned slurry. As the reconditioned slurry flows down the second table, it is dispersed and aerated with air emitted from the aerators, forming two fractions, a middling fraction containing the flotation reagent-coated phosphate particles and a second tailing containing non-coated gangue.

A second splitter is positioned along the path of flow of the reconditioned slurry as it flows down the second sloping flat table. The height of the second splitter above the surface of the second table is adjusted to intersect the flowing, reconditioned slurry at about the interface between the middling and tailing fractions. The middling substantially containing the flotation reagent-coated phosphate particles flows over the splitter and is collected. The tailing substantially containing non-coated gangue particles flows below the second splitter off the end of the second sloping flat table and is collected.

There is, thereby, obtained three fractions of the initial aqueous slurry containing phosphate particles; a concentrate, flowing above the first splitter which substantially contains a concentrate of phosphate particles; a middling, flowing above the second splitter which substantially contains phosphate particles which are of a lesser grade than the phosphate particles in the concentrate; and a tailing fraction which substantially contains gangue present in the raw phosphate ore.

The apparatus and method described herein can also be used for further beneficiation of the concentrate by conditioning the concentrate and recycling it as a feed to the initial trough or through another sloping table or series of sloping tables fitted with such dispersers, aerators and splitters. Although the apparatus is disclosed as having a table with parallel sides, such sides can also be non-parallel converging toward the splitter.

What is claimed is:

1. Apparatus for the concentration of ore comprising:

(a) a first trough;

(b) a side of the first trough extending outwardly forming a first downwardly sloping table which is enclosed by two parallel sides and open on an end opposite said first trough;

(c) a first splitter positioned near the first downwardly sloping table open end and adjustably above the surface of the first downwardly sloping table, the first splitter including a first downwardly sloping splitter table enclosed by two parallel sides and a first splitter collecting trough on an end of the first downwardly sloping splitter table;

(d) a second trough positioned below the open end of the first downwardly sloping table, said second trough including a side extending outwardly therefrom and forming a second downwardly sloping table which is enclosed by two parallel sides and open on an end opposite said second trough;

(e) a second splitter positioned near the second downwardly sloping table open end and adjustably above the surface of the second downwardly sloping table, the second splitter including a second downwardly sloping splitter table enclosed by two parallel sides and a second splitter collecting trough on an end of the second downwardly sloping splitter table;

(f) a third trough positioned below the open end of the second downwardly sloping table;

(g) at least one first aerator positioned along the surface of the first downwardly sloping table;

(h) at least one second aerator positioned along the surface of the second downwardly sloping flat table;

(i) at least one first disperser comprising a surface sloping upwardly and extending between the two parallel sides of the first downwardly sloping table positioned along the surface of the first downwardly sloping flat table between the first trough and the first aerator;

(j) at least one second disperser comprising a surface sloping upwardly and extending between the two parallel sides of the second downwardly sloping table positioned along the surface of the second downwardly sloping flat table between the second trough and the second aerator; and (k) means for feeding a conditioning reagent to said second trough.

2. Apparatus for the concentration of ore comprising:

(a) a downwardly sloping table;

(b) means for feeding a slurry of ore onto a higher end of said downwardly sloping table;

(c) aerator means disposed along the downwardly sloping table for aerating the ore slurry as the ore slurry flows along the downwardly sloping table;

(d) disperser means disposed in an operative relationship with said aerator means for dispersing ore particles, flowing within the ore slurry and near a surface of said downwardly sloping table, upwardly from said surface and over said aerator means; and (e) splitter means disposed proximate a lower end of said downwardly sloping table for separating the ore slurry into a float concentrate and a non-float fraction.

3. An apparatus for the concentration of ore comprising:

(a) a downwardly sloping table;

(b) trough means interconnected with said downwardly sloping table for feeding a slurry of ore onto a higher end of said downwardly sloping table;

(c) aerator means disposed along the downwardly sloping table for aerating the ore slurry as the ore slurry flows along the downwardly sloping table;

(d) disperser means disposed in an operative relationship with said aerator means for dispersing ore particles, flowing within the ore slurry and near a surface of said downwardly sloping table, upwardly from said surface and over said aerator means;

(e) splitter means disposed proximate a lower end of said downwardly sloping table for separating the ore slurry into a float concentrate and a non-float fraction, said splitter means including means for collecting the float concentrate; and (f) means disposed below the lower end of said downwardly sloping table for collecting the non-float fraction.

4. An apparatus for the concentration of ore comprising:

(a) a trough means including an outwardly extending side forming a downwardly sloping surface for conducting a slurry therealong, said downwardly sloping surface being enclosed by two parallel sides and open on an end opposite said trough means;

(b) at least one aerator means positioned along the downwardly sloping surface for aerating a slurry containing ore particles flowing along the downwardly sloping surface;

(c) at least one disperser means positioned along the downwardly sloping surface between the trough means and aerator means for dispersing ore particles above and near the downwardly sloping surface upwardly from the downwardly sloping surface;

(d) a collecting trough positioned below the open end of the downwardly sloping surface; and (e) a splitter means for separating the slurry into an upper float concentrate and a lower non-float fraction positioned near the downwardly sloping surface open end and adjustably above the downwardly sloping surface, said splitter means including a downwardly sloping splitter surface enclosed by two parallel sides and a splitter collecting trough on an end of the downwardly sloping splitter surface.

5. Apparatus for the concentration of ore comprising:

(a) a first trough;

(b) a side of the first trough extending outwardly forming a first downwardly sloping flat table which is enclosed by two parallel sides and open on an end opposite said first trough;

(c) a first splitter means for intersecting and separating a slurry containing ore particles flowing along the first downwardly sloping flat table into a float concentrate and a non-float fraction positioned near the first downwardly sloping flat open end and adjustably above the surface of the first downwardly sloping flat table, said first splitter means including a first downwardly sloping splitter table enclosed by two parallel sides and a first splitter collecting trough on an end of the first downwardly sloping splitter table;

(d) a second trough positioned below the open end of the first downwardly sloping flat table, said second trough including a side extending outwardly therefrom and forming a second downwardly sloping flat table which is enclosed by two parallel sides and open on an end opposite said second trough;

(e) a second splitter means for intersecting and separating a slurry containing ore particles flowing along said second downwardly sloping flat table into a float middling and a non-float tailings positioned near the second downwardly sloping flat table open end and adjustably above the surface of the second downwardly sloping flat table, said second splitter means including a second downwardly sloping splitter table enclosed by two parallel sides and a second splitter collecting trough on an end of the second downwardly sloping splitter table;

(f) a third trough positioned below the open end of the second downwardly sloping flat table;

(g) at least one first aerator means positioned along the surface of the first downwardly sloping flat table and at least one second aerator means positioned along the surface of the second downwardly sloping flat table, said first and second aerator means being operative for aerating the slurry flowing along such first and second downwardly sloping flat tables respectively;

(h) at least one first disperser means positioned along the surface of the first downwardly sloping flat table between the first trough and first aerator means and at least one second disperser means positioned along the surface of the second downwardly sloping flat table between the second trough and second aerator means, said first and second disperser means being operative for dispersing ore particles within the slurry near the surface of said first and second downwardly sloping flat tables respectively upwardly from the first and second downwardly sloping flat table surface respectively; and (i) means for feeding a conditioning reagent to said second trough.

6. Apparatus as recited in claim 1, 2, 3, 4 or 5 wherein the disperser means comprises a flat surface extending across the flow of slurry and sloping upwardly from the downwardly sloping table in the direction of flow of the slurry.

7. Apparatus as recited in claim 1, 2, 3, 4 or 5 wherein the disperser means comprises a curved surface extending across the flow of slurry and curved upwardly in the direction of flow of the slurry.

8. Apparatus as recited in claim 1, 2, 3, 4 or 5 wherein the disperser means comprises a surface capable of vibration.

9. A method for the concentration of an ore by separating float from non-float particles contained in a slurry of ore particles conditioned with a beneficiating amount of a flotation reagent comprising the steps of:

(a) feeding a conditioned particulate ore slurry into a trough wherein the conditioned slurry overflows the trough and onto a downwardly sloping flat table;

(b) dispersing ore particles near the surface of the downwardly sloping flat table upwardly in the slurry;

(c) aerating the conditioned slurry as it flows along the downwardly sloping flat table, to form a float concentrate interfaced with a non-float tailing within the conditioned slurry;

(d) positioning an adjustable splitter along the path of flow of the conditioned slurry at about the interface between the concentrate and tailing;

(e) separating the concentrate from the tailing by passing the concentrate over the splitter and passing the tailing below the splitter; and (f) separately collecting the concentrate the tailing.

10. A method as recited in claim 9 further comprising the steps of:

(a) conditioning the collected tailing of the ore slurry with a beneficiating amount of a flotation reagent;

(b) flowing the beneficiated ore slurry over a downwardly sloping flat table;

(c) dispersing ore particles near the surface of the downwardly sloping flat table upwardly in the slurry;

(d) aerating the beneficiated ore slurry as it flows over the sloping flat table, to form a middling interfaced with a tailing within the beneficiated ore slurry;

(e) positioning an adjustable splitter within the path of flow of the beneficiated ore slurry at about the interface between the middling and tailing, and separating the middling from the tailing by passing the middling over the splitter and passing the tailing below the splitter; and (f) separately collecting the middling and tailing.

11. A method as recited in claim 9 or 10 wherein the ore particles near the surface of the first and second sloping flat tables are dispersed by such dispersing means upwardly in the slurry reaching about a maximum height in the slurry at about the location of aeration of the slurry.

* * * * *

UNITED STATES PATENT AND TRADEMARK OFFICE

CERTIFICATE OF CORRECTION

PATENT NO. : 4,284,499

DATED : August 18, 1981

INVENTOR(S) : Brig M. Moudgil et al.

It is certified that error appears in the above-identified patent and that said Letters Patent is hereby corrected as shown below:

Column 13, line 4, "the", second occurrence, should read -- and --.

Signed and Sealed this

*Twenty-first* Day of *December 1982*

[SEAL]

*Attest:*

GERALD J. MOSSINGHOFF

*Attesting Officer*

*Commissioner of Patents and Trademarks*